US007234548B2

(12) United States Patent
Comarmond

(10) Patent No.: US 7,234,548 B2
(45) Date of Patent: Jun. 26, 2007

(54) HYDRAULIC ROTARY-PERCUSSIVE HAMMER DRILL

(75) Inventor: Jean-Sylvain Comarmond, Vourles (FR)

(73) Assignee: Montabert S.A., Saint Priest (FR)

( * ) Notice: Subject to any disclaimer, the term of this patent is extended or adjusted under 35 U.S.C. 154(b) by 331 days.

(21) Appl. No.: 10/504,055

(22) PCT Filed: Mar. 18, 2003

(86) PCT No.: PCT/FR03/00859

§ 371 (c)(1),
(2), (4) Date: Sep. 21, 2004

(87) PCT Pub. No.: WO03/078107

PCT Pub. Date: Sep. 25, 2003

(65) Prior Publication Data

US 2005/0016774 A1 Jan. 27, 2005

(30) Foreign Application Priority Data

Mar. 19, 2002 (FR) ..... 02 03402

(51) Int. Cl.
*E21B 4/14* (2006.01)

(52) U.S. Cl. ..... 175/296; 175/293; 173/103; 173/212

(58) Field of Classification Search ..... 175/293, 175/296, 298; 173/103, 210, 212, 101
See application file for complete search history.

(56) References Cited

U.S. PATENT DOCUMENTS 5,479,996 A * 1/1996 Jonsson et al. ..... 175/135

FOREIGN PATENT DOCUMENTS

| | | | |
|---|---|---|---|
| EP | 0 058 650 | A1 | 8/1982 |
| EP | 0 080 446 | A2 | 6/1983 |
| EP | 0 112 810 | A2 | 7/1984 |
| EP | 0 856 637 | A1 | 8/1998 |
| EP | 1 160 416 | A2 | 12/2001 |
| FR | 2 355 617 | | 1/1978 |
| FR | 2 647 870 | | 12/1990 |
| WO | WO 0201041 | A1 * | 1/2002 |

* cited by examiner

*Primary Examiner*—Jennifer H. Gay
*Assistant Examiner*—Giovanna M Collins
(74) *Attorney, Agent, or Firm*—Oliff & Berridge, PLC

(57) ABSTRACT

A hydraulic rotary percussive hammer drill includes a body containing a reciprocating percussion piston sliding under the effect of a main hydraulic supply circuit, this main circuit also being intended to cause the sliding of a roughly annular abutment piston housed in a cavity of the body, and having, on the one hand, a front face in contact with a shank and intended to place this shank a predetermined distance away from the percussion piston and, on the other hand, a rear face facing a rear wall of the cavity, characterized in that an external hydraulic supply circuit is able, when the main circuit is shut down, to introduce fluid under pressure between the rear face of the abutment piston and the rear wall of the cavity so as to maintain a space between these items.

14 Claims, 4 Drawing Sheets

1
2
4
31
23
22
19
24
6
17
16
8
5
7
3
9
10
11

HYDRAULIC ROTARY-PERCUSSIVE HAMMER DRILL

The present invention relates to a hydraulic rotary percussive hammer drill more especially used on a drilling rig.

BACKGROUND

A drilling rig comprises a hydraulic rotary percussive hammer drill sliding on a drilling jar and driving one or more drill rods, the last of these rods bearing a tool known as a bit which is in contact with the rock. Such a hammer drill generally is intended to bore rather deep holes so that explosive charges can be laid therein. The hammer drill is therefore the main element which, on the one hand, imparts rotation to the bit and imparts percussion via the drill rods so as to penetrate the rock, and, on the other hand, supplies an injection fluid to extract the debris from the bored hole.

A hammer drill comprises a mechanism, driven by one or more flows of hydraulic fluid from a main supply circuit of the percussion mechanism, acting on the drill rods via a shank which is able to pass on, on the one hand, the successive blows brought about by a percussion piston and, on the other hand, the rotation due to a rotary hydraulic motor.

The force with which the hammer drill bears against the drill rods, and therefore, by transmission, with which the bit bears against the rock, is obtained using the hydraulic motor of the drilling jar. More specifically, the bearing force is transmitted from the body of the hammer drill to the shank via an abutment element incorporated into the hammer drill. This abutment element may consist of a fixed rotary friction part, but more generally, in the case of high-power hammer drills, consists of an abutment piston one surface of which is hydraulically supplied so as to transmit the bearing force through a fluid.

European patent applications EP 0 058 650 and EP 0 856 637 disclose abutment piston devices for which the hydraulic supply comes from the main supply circuit of the percussion mechanism. However, when the operator shuts off this main supply circuit and he activates, for example, only the rotary motor, the surface of the abutment piston is no longer hydraulically supplied and the piston can therefore come into direct contact with the body of the hammer drill, something which may give rise to considerable damage.

SUMMARY

The hammer drill according to the present invention is intended to solve the abovementioned problem and for that purpose comprises a body containing a reciprocating percussion piston sliding under the effect of a main hydraulic supply circuit, this main circuit also being intended to cause the sliding of a roughly annular abutment piston housed in a cavity of the body, and having, on the one hand, a front face intended to position a shank a predetermined distance away from the percussion piston and, on the other hand, a rear face facing a rear wall of the cavity, characterized in that an external hydraulic supply circuit is able, when the main circuit is shut down, to introduce fluid under pressure between the rear face of the abutment piston and the rear wall of the cavity so as to maintain a space between these items.

Thus, the fact of combining an independent external supply circuit capable of delivering fluid between the rear face of the abutment piston and the rear wall of the cavity offers the operator the possibility of closing off the main circuit in complete safety because this fluid is able to form a hydraulic cushion preventing the abutment piston from rubbing against the body of the hammer drill.

Advantageously, the external supply circuit opens into the rear end of the cavity and a sliding annular sleeve is placed around the rear part of the abutment piston and is able, on the one hand, to prevent the introduction of the fluid delivered by the external supply circuit when the pressure in the rear chamber is above or equal to a predetermined value (P) and, on the other hand, to allow this fluid to be introduced when the pressure in the annular rear chamber is below the determined value (P).

As a preference, the abutment piston has a front part, a central shoulder and a rear part, the said central shoulder being flanked by an annular front chamber and an annular rear chamber, and the main supply circuit is intended to deliver a fluid directly into the rear chamber and a connecting duct is intended to place the rear chamber in free communication with the front chamber.

In addition, when the main supply circuit is activated, the rear face of the abutment piston is placed at the pressure of a drain by means of a first duct. Advantageously, the front chamber is also placed in communication with the drain by means of a second duct once the shank is distant from the percussion piston by less than the predetermined distance.

According to one particular embodiment of the invention, the abutment piston is intended to slide inside a guide secured to the body. As a preference, the sleeve has a rear part which, on the one hand, has an external shoulder exhibiting a first rear surface intended to collaborate with the external supply circuit and, on the other hand, an internal indentation exhibiting an offset second rear surface. As a further preference, a roughly annular chamber connected to the main circuit is provided between the external shoulder of the sleeve and a rear end of the guide. Finally, the front face of the abutment piston advantageously has a diameter significantly greater than that of the rear face.

The invention will be better understood with the aid of the detailed description set out hereinbelow with reference to the attached drawings in which:

DETAILED DESCRIPTION OF EMBODIMENTS

Figure 1:
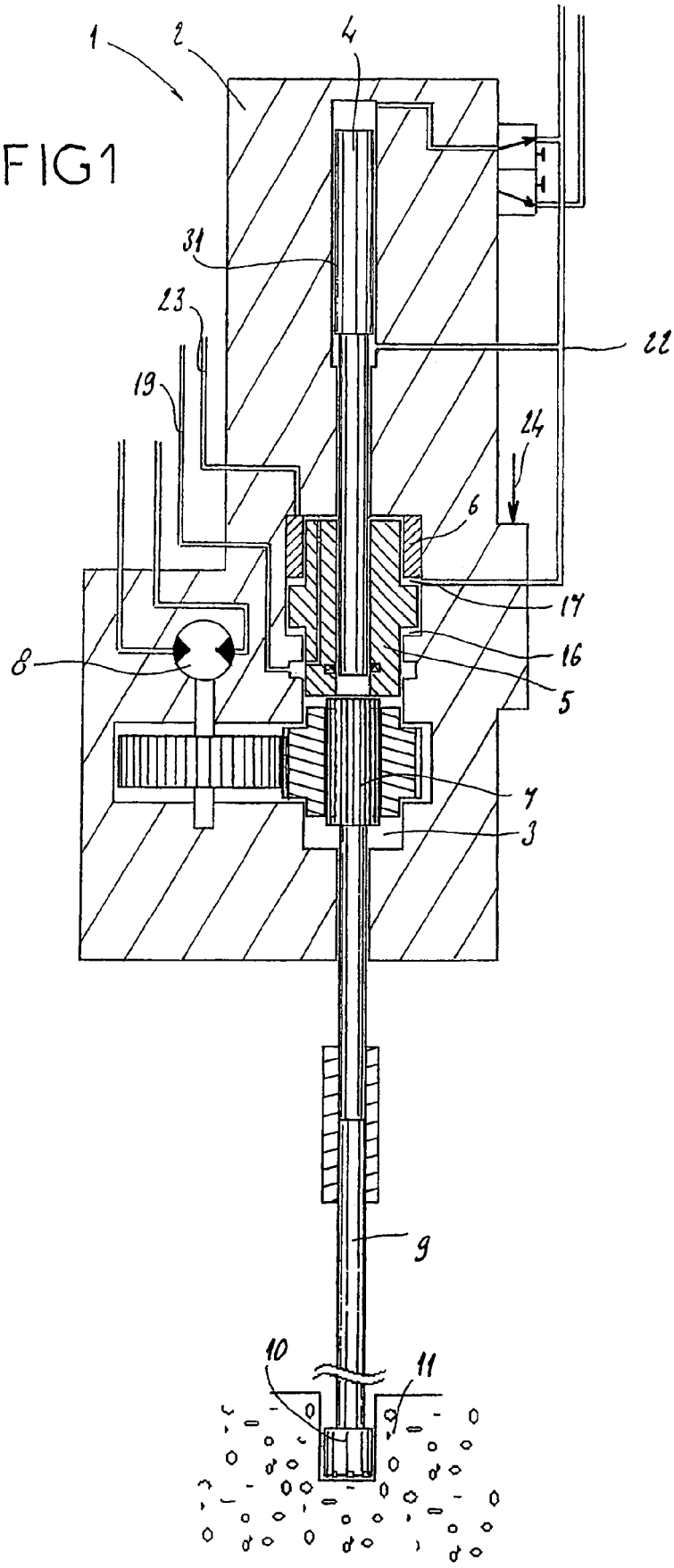
FIG. 1 is a view in longitudinal section of the hammer drill according to the invention equipped with drill rods in contact with the rock.
Figure 2:
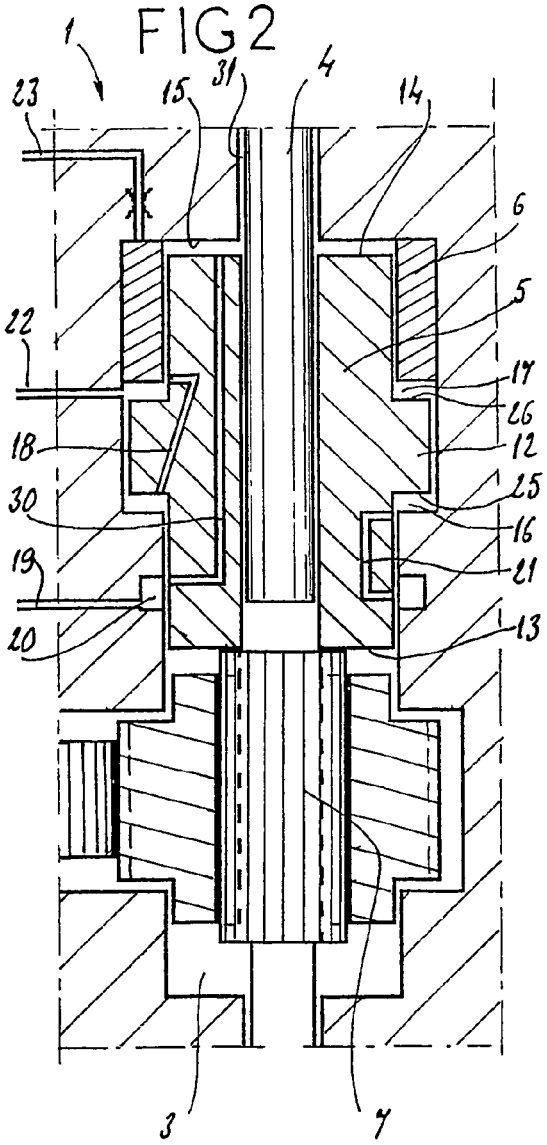
FIG. 2 is a view in longitudinal section and on a larger scale of the hammer drill depicted in FIG. 1 when the main hydraulic supply circuit is activated and the shank is at the predetermined distance from the percussion piston.
Figure 3:
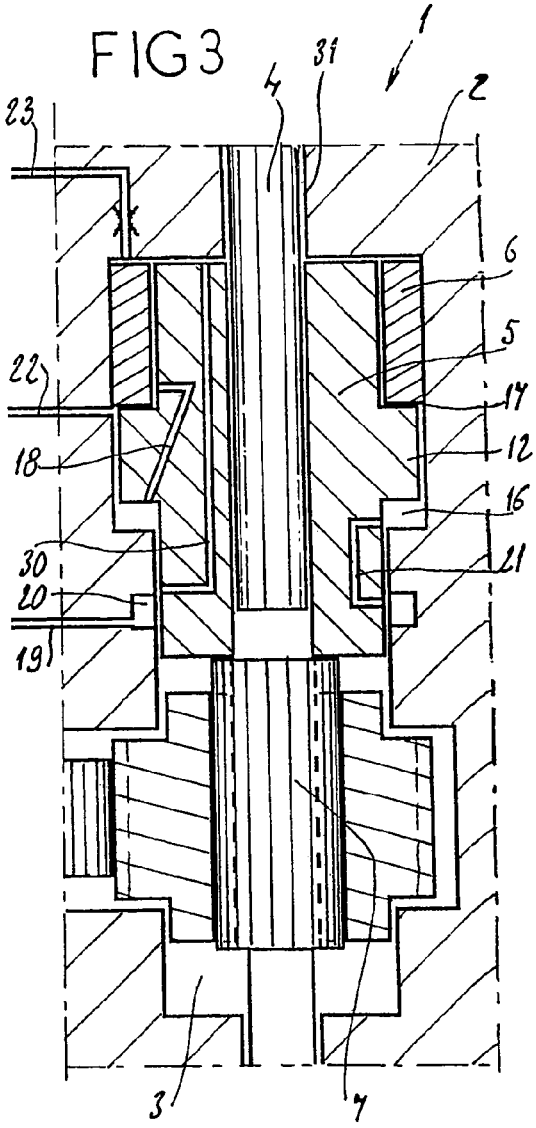
FIG. 3 is a sectional view similar to FIG. 2 when the main hydraulic supply circuit is shut off.

With reference to FIGS. 1 to 3, a hammer drill 1 according to the invention has a body 2 comprising a cavity 3 which extends towards the rear in the form of a bore 31 containing a percussion piston 4. More specifically, the cavity 3 contains a roughly annular abutment piston 5 which can slide around the percussion piston 4, an annular sleeve 6, a shank 7 and a rotary motor 8. The shank 7 is connected to drill rods 9 which act on a bit 10 in contact with the rock 11.

The abutment piston 5 has a front part, a central shoulder 12 and a rear part, the central shoulder comprising a front annular surface 25 and a rear annular surface 26. At its front part and at its rear part the abutment piston is equipped respectively with a front face 13 and with a rear face 14. More specifically, the front face 13 is in contact with the shank 7 and the rear face 14 faces a rear wall 15 of the cavity 3. The sleeve 6 is placed around the rear part of the abutment piston 5 and can slide with sealing along the latter. Furthermore, the front part of the abutment piston 5, the front surface 25 of the central shoulder 12 and the body 2 define an annular front chamber 16. Likewise, the rear part of the abutment piston 5, the rear surface 26 of the central shoulder 12, the body 2 and the sleeve 6 define an annular rear chamber 17.

A connecting duct 18 is provided so that, in operation, the front chamber 16 and the rear chamber 17 can be placed at the same pressure. A first duct 30 passing longitudinally through the abutment piston 5 across its entire rear part allows the rear face 14 of the abutment piston 5 to be placed at the pressure of a drain 19 via a groove 20. Finally, a second duct 21 formed in the front part of the abutment piston allows the front chamber 16 to be placed in communication with the groove 20 and the drain 19.

A main hydraulic supply circuit 22 supplying the hammer drill 1 is connected to the bore 31 containing the percussion piston 4, but is also connected to the rear chamber 17. In addition, an external hydraulic supply circuit 23 independent of the main circuit 22 has an end opening into the rear end 15 of the cavity 3 at the sleeve 6.

In operation, the hydraulic motor of the drilling jar (not depicted) containing the hammer drill 1 applies a bearing force to the body 2, as illustrated by the arrow 24. This bearing force is transmitted to the abutment piston 5 by means of the main circuit 22 which generates a fluid under pressure in the rear chamber 17 so as to exert stress on the rear surface 26 of the shoulder 12 and on the sleeve 6. The abutment piston 5 is therefore made to slide forwards and transmits the bearing force via its front face 13 to the shank 7, and therefore to the drill rods 9 and to the bit 10. By contrast, the sleeve 6 is pushed backwards and blocks off the external circuit 15. By virtue of the connecting duct 18, the abutment piston 5 halts its travel because the pressures in the front chamber 16 and the rear chamber 17 reach equilibrium which means that the shank 7 is then placed at an adequate predetermined distance from the percussion piston 4. It should be noted that the shank 7 is kept in this position because, where it tended to retreat, the second duct 21 would be able to place the front chamber 16 in communication with the drain 19, which would have the result of moving the abutment piston 5 forwards. Finally, the percussion piston 4 can strike the shank 7 by sliding in its housing 31 under the effect of the pressure of the fluid in the main circuit 22. Likewise, the rotary motor can be actuated and act on the shank 7.

By contrast, when the hammer drill 1 is no longer supplied by the main circuit 22, the pressure in the rear chamber 17 falls, and this has the effect of causing the abutment piston 5 to retreat towards the rear end 15 of the cavity 3 of the body 2. The rear face 14 of the abutment piston is then quickly no longer subjected to the pressure of the drain 19 because the connecting duct 30 is progressively blocked off. When the pressure in the rear chamber 17 drops below a determined value P, the fluid under pressure delivered by the external circuit 23 then exerts sufficient stress on the sleeve 6 to force the latter to slide forwards. As a result, fluid insinuates itself between the rear face 14 of the abutment piston 5 and the rear wall 15 of the cavity 3 so as to prevent any contact between these items. It should be noted that the rotary motor 8 can continue to operate even when the main circuit 22 is shut off.

Figure 4:
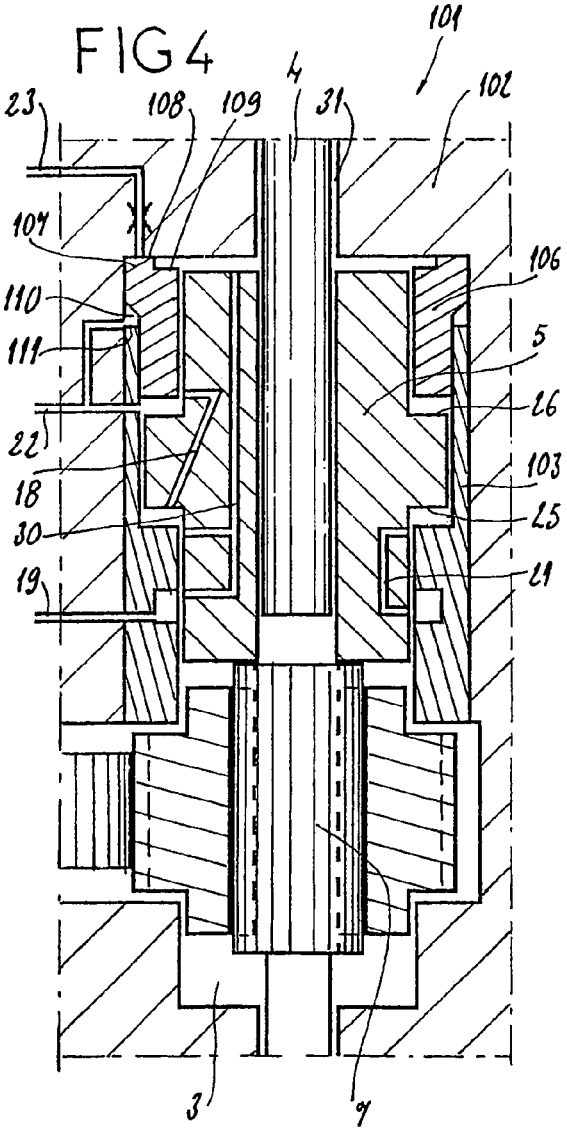
FIG. 4 is a view in longitudinal section of a hammer drill according to another embodiment of the invention when the main hydraulic supply circuit is activated and the shank is at the predetermined distance from the percussion piston.
Figure 5:
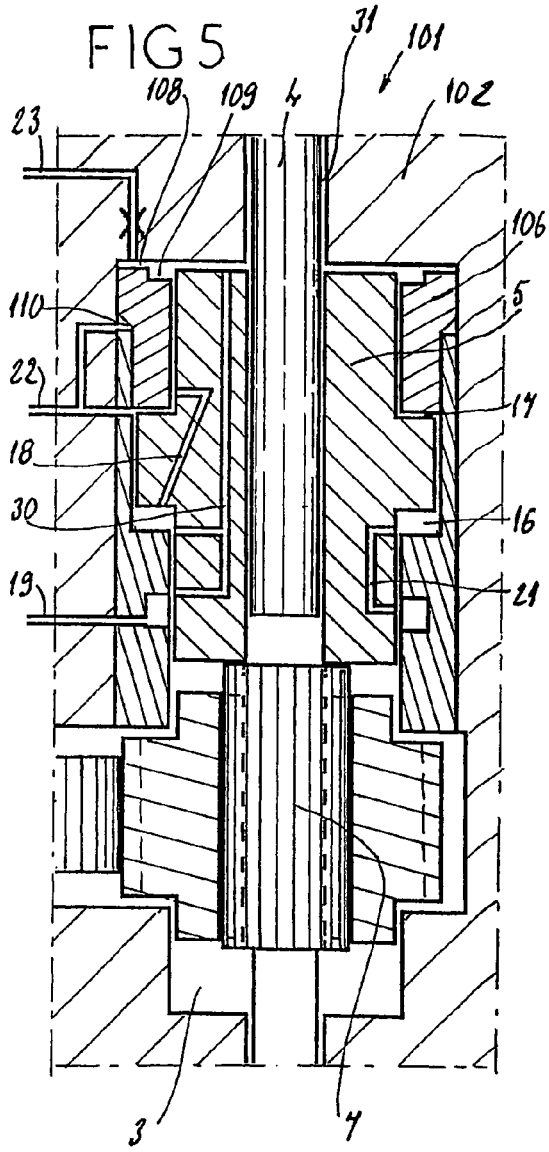
FIG. 5 is a view in longitudinal section of the hammer drill of FIG. 4 when the main hydraulic supply circuit is shut off.

FIGS. 4 and 5 describe a hammer drill 101 according to the particular embodiment of the invention. Only the differences between this hammer drill 101 and the one depicted in FIGS. 1 and 3 will be described hereinafter. This hammer drill 101 has a body 102 and differs from the one depicted in FIGS. 1 to 3 mainly in that, on the one hand, the abutment piston 5 is now made to slide inside a guide 103 secured to the body 102 and, on the other hand, the sleeve 6 is replaced with a sleeve 106 provided with an external shoulder 107 and an internal indentation. More specifically, the external shoulder 107 has a first rear surface 108 intended to collaborate with the external circuit 23 and the internal indentation has a second rear surface 109 offset from the first rear surface 108. In operation, this second rear surface 109 is then placed at the pressure of the drain 19. In addition, a roughly annular chamber 110 is provided between the external shoulder 107 and a rear end 111 of the guide 103, and this annular chamber 110 is connected to the main hydraulic supply circuit 22.

The operation of the hammer drill 101 is similar to that described earlier in respect of the hammer drill 1. It should merely be pointed out that when the hammer drill 101 is supplied by the main circuit 22, the fluid under pressure is delivered to the rear chamber 17 but also to the chamber 110. The advantage with this particular embodiment of the invention lies in the fact that the area of the front surface 25 and the area of the rear surface 26 of the shoulder 12 of the abutment piston 5, together with the areas of the first and second rear surfaces 107, 108 of the sleeve 106 can easily be chosen so that the minimum pressure generated by the external circuit 23 needed to move the sleeve 106 is very much higher than the pressure generated by the main circuit 22 in the rear chamber 17 and the chamber 110.

Figure 6:
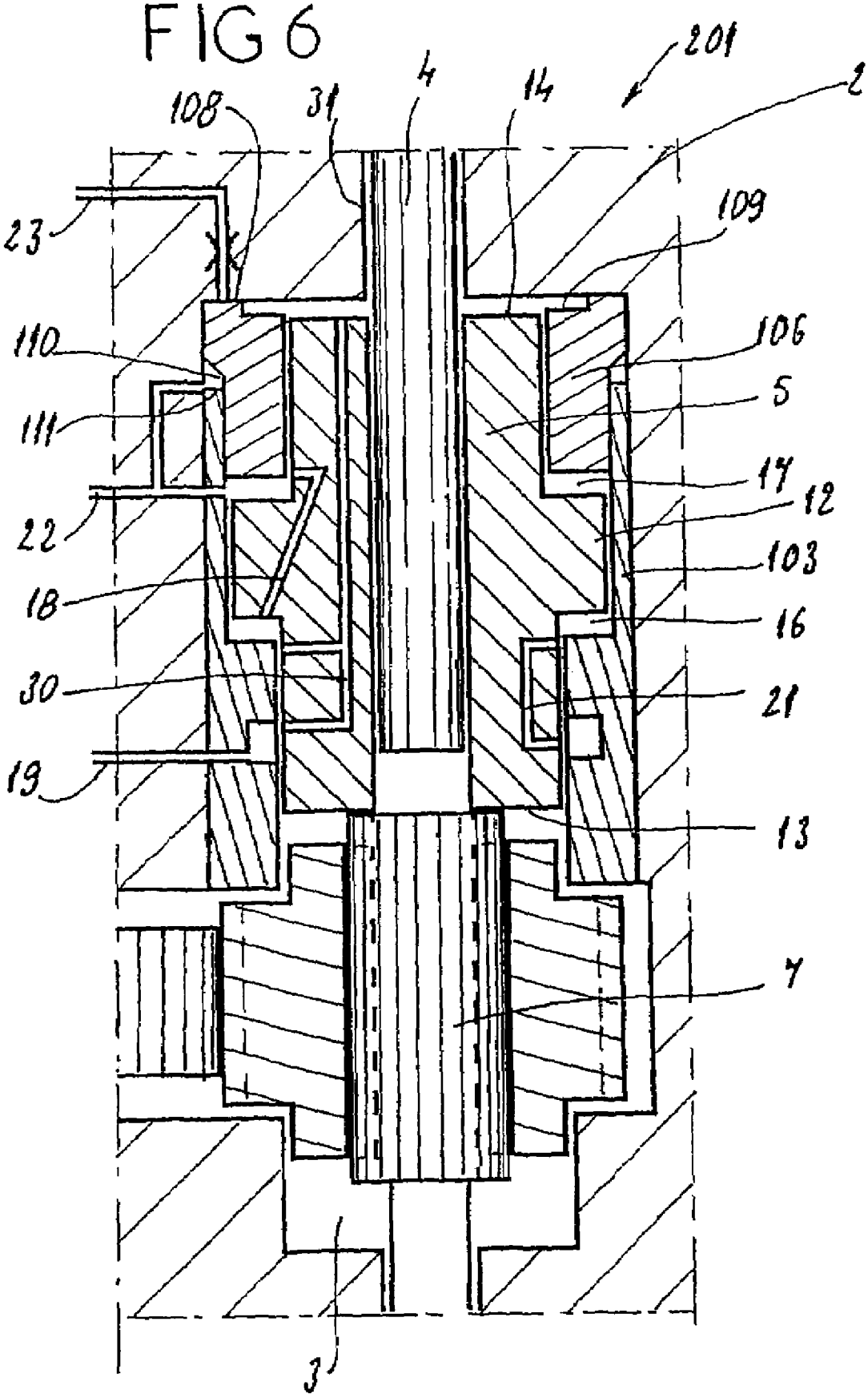
FIG. 6 is a view in longitudinal section of a hammer drill similar to the one depicted in FIG. 4, the only difference being that the front face of the abutment piston has a diameter appreciably greater than that of the rear face.

FIG. 6 describes a hammer drill 201 which differs from the hammer drill 101 depicted in FIGS. 4 and 5 solely in that the front face 13 of the abutment piston 5 has a diameter appreciably greater than that of the rear face 14. In operation, the result of this is to push the piston forwards, even beyond its position of equilibrium, because when the front chamber 16 and the rear chamber 17 are at the same pressure, the difference in diameter between the front face 13 and the rear face 14 leads to the creation of an additional annular cross sectional area for forward thrust. This then has the advantage of allowing the front face 13 of the abutment piston 5 to remain in contact with the shank 7 for longer in spite of the significant vibrational movements associated with the striking of the percussion piston 4 against the shank 7.

Although the invention has been described in conjunction with some particular exemplary embodiments, it is clearly obvious that it is not in any way restricted thereto and that it encompasses all technical equivalents of the means described and combinations thereof where these fall within the scope of the invention.

The invention claimed is:

1. A hydraulic rotary percussive hammer drill comprising a body containing a reciprocating percussion piston sliding under the effect of a main hydraulic supply circuit, this main circuit also being intended to cause the sliding of a roughly annular abutment piston housed in a cavity of the body, and having, on the one hand, a front face intended to position a shank a predetermined distance away from the percussion piston and, on the other hand, a rear face facing a rear wall of the cavity, wherein:

an external hydraulic supply circuit is able, when the main circuit is shut down, to introduce fluid under pressure between the rear face of the abutment piston and the rear wall of the cavity so as to maintain a space between these items; and the external circuit opens into the rear end of the cavity and in that a sliding annular sleeve is placed around a rear part of the abutment piston and is able, on the one hand, to prevent the introduction of the fluid delivered by the external circuit when a pressure in a rear chamber is above or equal to a predetermined value and, on the other hand, to allow this fluid to be introduced when the pressure in the rear chamber is below the determined value.

2. The hammer drill according to claim 1, wherein the abutment piston has a front part, a central shoulder and the rear part, the said central shoulder being flanked by an annular front chamber and the annular rear chamber, and in that the main circuit is intended to deliver a fluid directly into the rear chamber and in that a connecting duct is intended to place the rear chamber in free communication with the front chamber.

3. The hammer drill according to claim 2, wherein when the main circuit is activated, the rear face of the abutment piston is placed at a pressure of a drain by means of a first duct.

4. The hammer drill according to claim 2, wherein the abutment piston is intended to slide inside a guide secured to the body.

5. The hammer drill according to claim 1, wherein when the main circuit is activated, the rear face of the abutment piston is placed at a pressure of a drain by means of a first duct.

6. The hammer drill according to claim 5, wherein the front chamber is placed in communication with the drain by means of a second duct once the shank is distant from the percussion piston by less than the predetermined distance.

7. The hammer drill according to claim 6, wherein the abutment piston is intended to slide inside a guide secured to the body.

8. The hammer drill according to claim 5, wherein the abutment piston is intended to slide inside a guide secured to the body.

9. The hammer drill according to claim 1, wherein the abutment piston is intended to slide inside a guide secured to the body.

10. The hammer drill according to claim 9, wherein the sleeve has a rear part which, on the one hand, has an external shoulder exhibiting a first rear surface intended to collaborate with the external circuit and, on the other hand, an internal indentation exhibiting an offset rear second surface.

11. The hammer drill according to claim 10, wherein a roughly annular chamber connected to the main circuit is provided between the external shoulder of the sleeve and a rear end of the guide.

12. The hammer drill according to claim 11, wherein the front face of the abutment piston has a diameter significantly greater than that of the rear face.

13. The hammer drill according to claim 10, wherein the front face of the abutment piston has a diameter significantly greater than that of the rear face.

14. The hammer drill according to claim 9, wherein the front face of the abutment piston has a diameter significantly greater than that of the rear face.

* * * * *